United States Patent [19]

Engels

[11] 4,188,130

[45] Feb. 12, 1980

[54] DEVICE FOR CONTINUOUSLY MIXING WOOD CHIPS WITH BINDER

[75] Inventor: Kaspar Engels, Mannheim, Fed. Rep. of Germany

[73] Assignee: Draiswerke GmbH, Mannheim, Fed. Rep. of Germany

[21] Appl. No.: 943,983

[22] Filed: Sep. 20, 1978

[30] Foreign Application Priority Data

Oct. 4, 1977 [DE] Fed. Rep. of Germany ..... 2744522

[51] Int. Cl.[2] ..... B01F 9/00

[52] U.S. Cl. ..... 366/228; 118/418; 366/156; 366/175; 366/180

[58] Field of Search ..... 366/228, 229, 227, 233, 366/93, 156, 160, 180, 181, 182, 167, 135, 34, 37; 118/418

[56] References Cited

U.S. PATENT DOCUMENTS

| | | | |
|---|---|---|---|
| 2,761,420 | 9/1956 | Mottet | 118/418 |
| 3,407,511 | 10/1968 | Camm | 366/228 |
| 3,798,338 | 3/1974 | Galle | 118/418 |
| 3,940,120 | 2/1976 | Miller | 366/228 |
| 3,974,307 | 8/1976 | Bowen | 118/418 |

*Primary Examiner*—Billy S. Taylor

*Attorney, Agent, or Firm*—Browdy and Neimark

[57] ABSTRACT

A process and apparatus for continuously mixing wood chips with a binder finely divided in air, the wood chips falling through a mixing drum in the form of thin layers with the air moving approximately perpendicularly to the direction of falling in a pulsating fashion.

3 Claims, 3 Drawing Figures

DEVICE FOR CONTINUOUSLY MIXING WOOD CHIPS WITH BINDER

FIELD OF THE INVENTION

The invention relates to a process for continuously mixing wood chips with a binder, in particular a binder in powder form, whereby the binder is finely divided in air and the wood chips are moved by this air, and apparatus for carrying out this process consisting of a cylindrical mixing drum rotatable about its center lengthwise with an inlet for the wood chips in one end and an outlet for the wood chips coated with binder at the other end, of components built in for lifting wood chips from a chip bed located in the mixing drum, and of means for dispersing binder in the interior space of the mixing drum.

BACKGROUND OF THE INVENTION

German Offenlegungsschrift No. 16 53 181 teaches a device for wetting wood fibers with liquid binder, which device has a mixing drum rotatable about its center lengthwise axis. In a fixed position with respect to the mixing drum the device consists of one spiked roller with a cover plate or two spiked rollers rotating in opposite directions located in the vicinity of the ascending mixing drum wall, by means of which device wood fibers rising with the mixing drum wall are thrown back at the same speed and in the same direction to the wood fiber bed located in the lower region of the mixing drum. Spray nozzles which spray liquid binder onto the wood fibers as they move by are located immediately above this trajectory. With this device, insufficiently uniform distribution of the binder on the wood fibers is unavoidable. The same is true when such a device is used for coating wood chips with glue. The reason for this is that the binder sprayed directly onto the wood fibers cannot be subjected to a distribution process on the surfaces of the fibers.

It is already known that powdered binder can be blown onto the wood chips together with compressed air by means of devices with the same basic design. Here, too, nonuniform distribution of the binder is unavoidable. Furthermore, removal of the air introduced additionally into the interior space of the mixing drum poses considerable problems.

SUMMARY OF THE INVENTION

An object of the present invention is to create a method and apparatus of the type described in the preamble hereof by means of which optimum distribution of the binder on the surface of the wood chips is achieved at a lower cost.

This problem is solved in a process of the type of device described above by the chips being moved in the form of thin descending layers, whereby these layers are alternately moved in the direction of the perpendiculars (normals) to their surfaces, and whereby the air which keeps the binder in suspension is moved in pulses approximately perpendicularly to the direction of falling and at right angles to the perpendiculars to the surface. The transverse movement of the wood chip layers produced forms continuously changing low-pressure and high-pressure areas into which the binder held in suspension by the air penetrates and out of which it flows away, producing continuously pulsating air streams which flow past the large surfaces of the wood chips, whereby the binder suspended in the air in a very fine distribution is deposited on the wood chip surfaces uniformly and in a very finely divided state from the air by condensation or like the settling of dust. The process according to the invention is therefore particularly advantageous if only very small binder particles, namely about 2–5% of the wood chips, are to be distributed uniformly on the wood chips. Thus in the process according to the invention there is no distribution of glue on the wood chips by means of higher kinetic energy, but by means of an additional intimate mixing process which is produced by the axially pulsating air streams and the layers of wood chips moved perpendicularly thereto.

The problem of the invention is solved by means of an apparatus of the type described in the preamble by providing open pockets in the inside wall of the mixing drum and in its direction of rotation. These pockets become filled as they pass through the chip bed located in the lower part of the mixing drum and empty as the responding drum wall rises. Since, due to their movement in a circular path, these pockets also execute a movement at right angles to the drum axis, these wood chip layers produced by the pockets move in the manner described.

BRIEF DESCRIPTION OF THE DRAWINGS

Other advantages and features of the invention will emerge from the subclaims and the description hereinbelow of one embodiment with reference to the drawing. In the drawing

DESCRIPTION OF PREFERRED EMBODIMENTS

Figure 1:
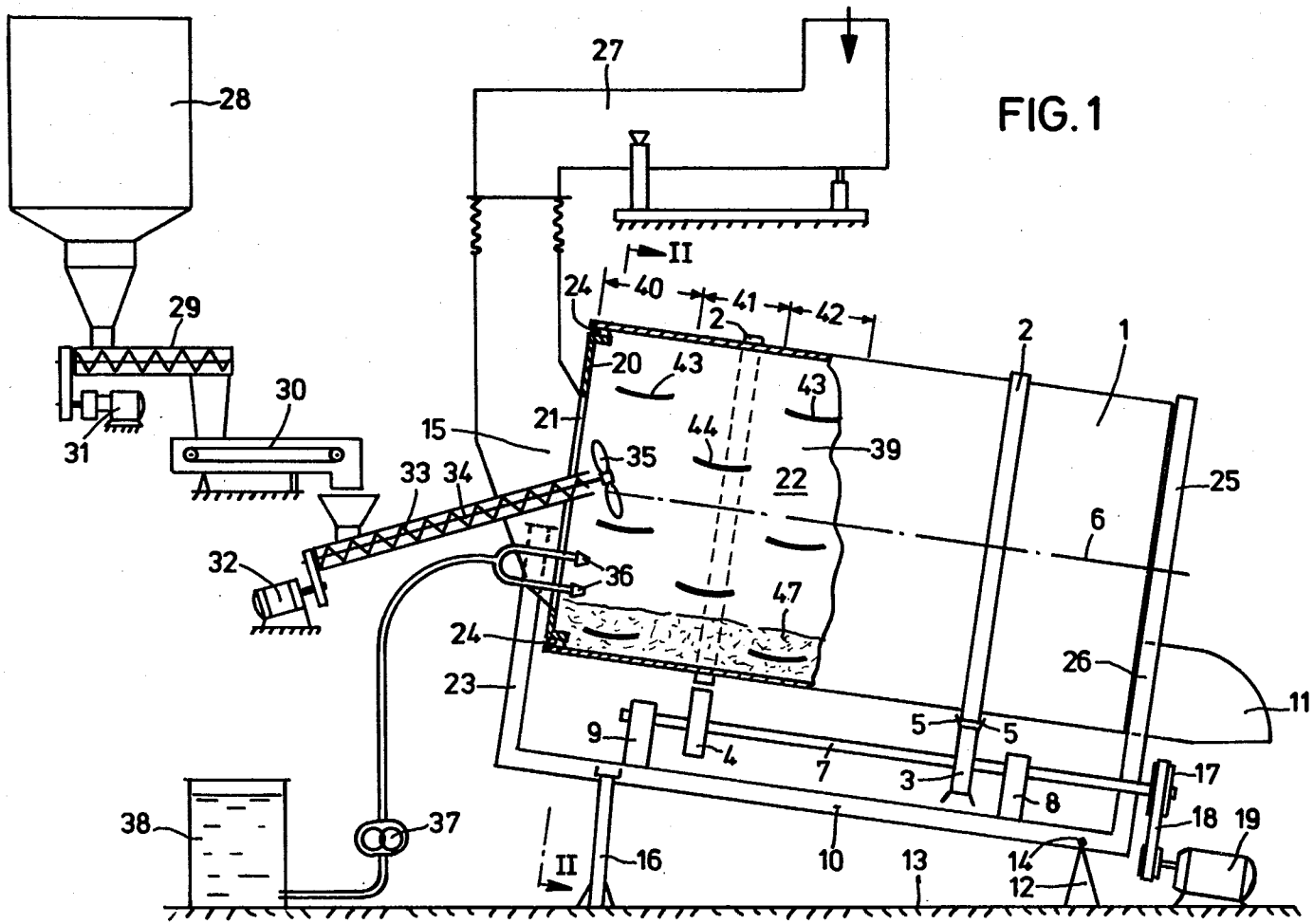
FIG. 1 shows schematically a vertical side view of the device according to the invention.

The device shown in the drawing has a cylindrical mixing drum 1 which has the comparatively large diameter of 2 to 3 meters. It is provided around its outer periphery with support rings 2 extending all around it, these support rings being associated pairwise with support rollers 3, 4. A support roller pair 3 located in one radial plane and associated with a support ring 2 is provided with guide rings 5 gripping one side of the associated support ring 2, so that mixing drum 1 is nondisplaceably mounted on guide rollers 3, 4 in the direction of its central lengthwise axis 6. Support rollers 3, 4, each of which is on one side, are nonrotatably mounted on a common shaft 7 which in its turn is mounted on pedestals 8, 9. Pedestals 8, 9 are mounted on a base frame 10. This base frame is mounted at one end, namely the end adjacent to outlet chute 11 of mixing drum 1 with respect to floor 13 by means of a pivot 12, the swiveling axis 14 of said base frame running horizontally and perpendicularly to central lengthwise axis 6. At its other end adjacent to an inlet chute 15, the base frame is supported on both sides by means of threaded spindles 16 with respect to floor 13, so that the angle of mixing drum 1 to the horizontal can be altered in such a manner that mixing drum 1 can be tilted slightly downward from inlet chute 15 to outlet chute 11.

One of the two shafts 7 is provided at one free end with a V-belt pulley 17 drivable by means of V-belt 18 by a fixed drive motor 19 thereby causing mixing drum 1 to rotate.

The end of mixing drum 1 facing inlet chute 15 is closed off by a circular end wall 20 on which inlet chute 15 is mounted, with an associated inlet aperture 21 in said end wall 20 providing a passage into the interior 22 of mixing drum 1. Inlet chute 15 and hence end wall 20 is supported by supports 23 with respect to base frame 10, namely end wall 20 is fixed with respect to base frame 10 and does not rotate with mixing drum 1. If desired, profiled joints 24 are provided on its periphery, which joints provide a substantially dust-proof seal between end wall 20 and mixing drum 1.

An end wall 25 is provided in front of the end wall associated with outlet chute 11, which wall is also supported on base frame 10 and does not rotate with the drum and which wall has an outlet aperture 26 providing a passage into outlet chute 11. Outlet chute 11 is firmly mounted on this end wall 25.

Inlet chute 15 is located upstream of a conveyor type weigher 27, shown schematically in the drawing, which in its turn is associated with a volumetrically dispensing delivery device (not shown) of a hopper. This conveyor type weigher 27 has a gravimetrically operating control device and the volumetrically dispensing delivery device of a hopper located upstream of it, connected to a control circuit so that a continuous stream of wood ships in a precisely preset quantity by weight per unit time is fed into mixing drum 1 through inlet chute 15. The aforementioned dispensing devices are traditional and generally known.

Furthermore, a hopper 28 for powdered binder is provided, which binder is removed from the hopper through a volumetrically operating dispensing unit 29 in the form of a screw conveyor and fed by means of a gravimetrically operating control unit in the form of a conveyor type weigher. Drive 31 of dispensing unit 29 and control unit 30 are also connected in a closed control circuit so that a continuous stream of powdered binder with a preset quantity by weight per unit time leaves control device 30. This flow of material is fed into the interior 22 of mixing drum 1 through end wall 20 by means of a screw conveyor driven by drive 32. A swirling device 35 in the form of a propeller is mounted on shaft 34 of screw conveyor 33, at its end located in interior 22, which swirling device divides the powdered binder leaving screw conveyor 33 and swirls it around. The propeller is driven at a correspondingly high speed.

Alternatively to or cumulatively with this feed device for powdered binder, one or more nozzles 36 projecting into interior 22 are provided in end wall 20, which nozzles are connected via a metering pump 37 to a supply tank 38 for liquid binder, so that liquid binder can be injected into interior 22 in a very finely divided form and in specific preset quantities by weight per unit time.

Shovel-like plates 43, 44 are provided on the inner wall 39 of mixing drum 1 in axially consecutive cylinder sections, of which only three cylinder sections 40, 41, 42 are shown, which plates 43, 44, are distributed equidistantly around the periphery, and are disposed respectively in two adjacent cylinder sections 40, 41 in such a way that they are staggered with respect to each other around the periphery of inner wall 39 by half the distance between two plates 43 or 44 in one cylinder section 40 or 41. Shovel-like plates 43 as viewed from the outside to the inside, are pitched in the rotational direction 45 of the mixing drum with respect to the corresponding radius, so that a pocket 46 is formed between plate 43 and 44 and the associated section of inner wall 39 of mixing drum 1. As the drum moves in rotational direction 45, a specific quantity of wood chips is scooped up from the wood chip bed 47 in the lower part of mixing drum 1 into such a pocket 46. These wood chips in pocket 46 flow over the inner edge 48 of plate 43, 44 as the drum rotates, in the form of a relatively thin parabolic layer 49, 50 back into wood chip bed 47. As may be seen from FIG. 2, a wood chip layer 49, from the beginning of emptying of a pocket 46 former by a plate 43 until complete emptying migrates transversely through the mixing drum 1 so that between this layer 49 and the part of inner wall 39 turned toward it (on the left in FIG. 2) a space 51 is produced which enlarges as the pocket empties, in which space a certain negative pressure arises as it steadily increases in size.

Figure 2:
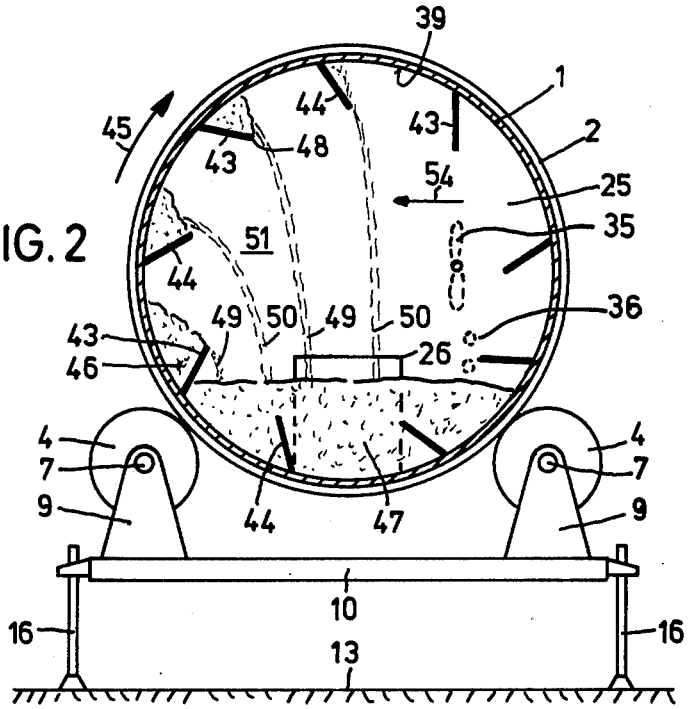
FIG. 2 is a cross-sectional view taken along the line II—II in FIG. 1.
Figure 3:
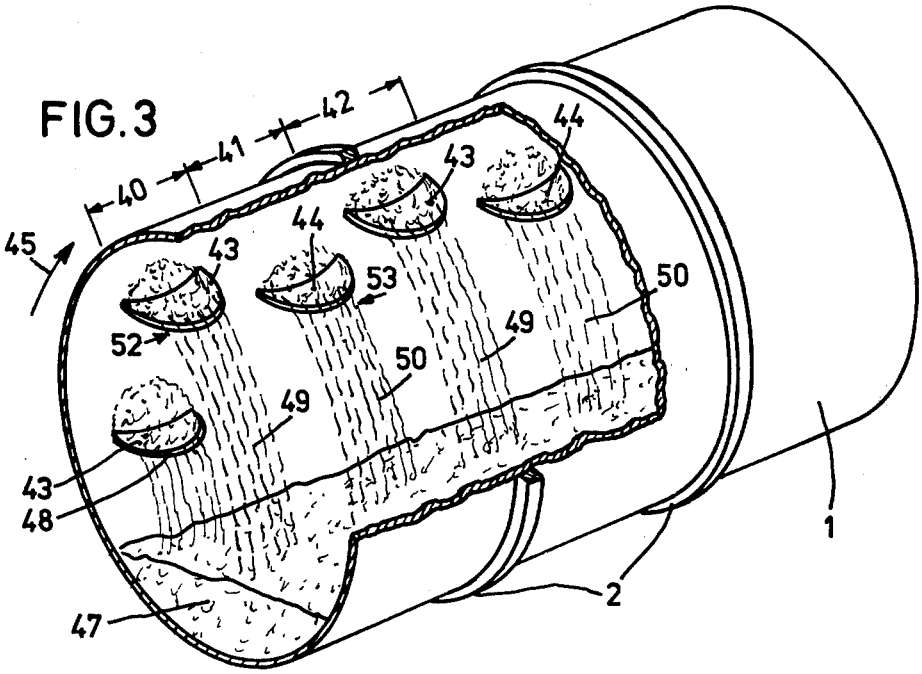
FIG. 3 is a partial perspective view of the interior space of the mixing drum.

As may be seen from FIG. 3, because of the staggered arrangement of plates 43, 44 in adjacent cylinder sections 40, 41 or 41, 42, the layers 49, 50 which form are also staggered with respect with one another so that the negative pressure developing in the individual spaces 51 behind layers 49, 50 can be equalized by axial air flows in the directions shown by arrows 52, 53. Because, in each cylinder section 40, 41, 42, several plates 43, 44 are located on the periphery of inner wall 39 of mixing drum 1, axially pulsating air streams in the direction of arrows 52, 53 develop, and these cause the powdered or droplet-shaped binder particles suspended in interior 22 to be drawn with them into space 51, and also to pulsate in the axial direction, hence arriving on the surfaces of the individual wood chips in a very finely divided form. Furthermore, when a layer 49 or 50 breaks up when a pocket 46 is completely empty, pressure equalization takes place at right angles to the lengthwise axis 6 in the direction of arrow 54 in FIG. 2, whereby in the region where, shortly before, a space 51 had been under negative pressure, a slight excess pressure now develops. This causes an interplay of axially and radially pulsating negative pressure and excess pressure waves, which cause extremely fine division of the binder particles throughout the interior 22 of mixing drum 1 and an extremely fine distribution of the binder particles over the individual wood chips.

In order to distribute the suspended binder, both powdered and liquid, throughout the entire interior 22 of mixing drum 1, screw conveyor 33 on the one hand and nozzles 36 on the other, as shown in FIG. 7, terminate in the vicinity of that part of interior 22 toward which layers 49, 50 do not migrate, so that the binder is not sprayed directly onto the wood chips.

As may be seen from FIGS. 2 and 3, layers 49, 50 are thin by comparison to their width, which corresponds approximately to the axial extent of plates 43, 44.

The above-mentioned transverse movement of layers 49, 50 in mixing drum 1 is approximately in the direction of the normals to the surfaces of these layers, which normals extend approximately opposite to the direction arrow 54.

By means of swirling device 35, air streams are also generated in the lengthwise direction of mixing drum 1, which streams reinforce the above-mentioned axially pulsating air streams and, in the same way as these air streams, generate air streams across both large surfaces of layers 49, 50.

It will be obvious to those skilled in the art that various changes may be made without departing from the scope of the invention and the invention is not to be considered limited to what is shown in the drawings and described in the specification.

What is claimed is:

1. Apparatus for continuously mixing wood chips with a binder, comprising a cylindrical mixing drum having end walls and drivable about its central lengthwise axis, said drum having an inlet aperture for the wood chips in one end wall and an outlet aperture for the wood chips coated with binder in the other end wall, built in pockets provided on the inner wall of said drum, said pockets being open in the rotational direction of said drum, to scoop up wood chips from a chip bed located in the bottom of said drum, and means for distributing the binder in the interior of the mixing drum, wherein said means for distributing said binder terminate in the area of the interior of said drum which is associated with the descending part of said drum wall.

2. Apparatus for continuously mixing wood chips with a binder, comprising a cylindrical mixing drum having end walls and drivable about its central lengthwise axis, said drum having an inlet aperture for the the wood chips in one end wall and an outlet aperture for the wood chips coated with binder in the other end wall, built in pockets provided on the inner wall of said drum, said pockets being open in the rotational direction of said drum, to scoop up wood chips from a chip bed located in the bottom of said drum, and means for distributing the binder in the interior of the mixing drum, wherein an air swirling device is provided in the interior of said drum, causing air to swirl in the lengthwise direction thereof and wherein a screw conveyor is provided for introducing said binder, said screw conveyor terminating in the area of said air swirling device in the interior of said mixing drum.

3. Apparatus for continuously mixing wood chips with a binder, comprising a cylindrical mixing drum having end walls and drivable about its central lengthwise axis, said drum having an inlet aperture for the wood chips in one end wall and an outlet aperture for the wood chips coated with binder in the other end wall, built in pockets provided on the inner wall of said drum, said pockets being open in the rotational direction of said drum, to scoop up wood chips from a chip bed located in the bottom of said drum, and means for distributing the binder in the interior of the mixing drum, wherein an air swirling device is provided in the interior of said drum, causing air to swirl in the lengthwise direction thereof, wherein a screw conveyor is provided for introducing said binder, said screw conveyor terminating in the area of said air swirling device, and wherein a propeller coupled with said screw conveyor is provided as the air swirling device.

* * * * *